United States Patent [19]

Carmody

[11] 4,411,316

[45] Oct. 25, 1983

[54] SUBTERRANEAN WELL VALVE WITH LOCK OPEN MECHANISM

[75] Inventor: Michael A. Carmody, Houston, Tex.

[73] Assignee: Baker International Corporation, Orange, Calif.

[21] Appl. No.: 232,473

[22] Filed: Feb. 9, 1981

[51] Int. Cl.[3] ..... E21B 34/10

[52] U.S. Cl. ..... 166/323; 166/72; 166/375

[58] Field of Search ..... 166/321, 322, 323, 325, 166/334, 72, 375

[56] References Cited

U.S. PATENT DOCUMENTS

| | | | |
|---|---|---|---|
| 2,447,842 | 8/1948 | Cameron et al. | 166/323 |
| 3,786,865 | 1/1974 | Tausch | 166/323 |
| 3,995,692 | 12/1976 | Seitz | 166/318 |
| 4,088,298 | 5/1978 | Brown | 166/334 |

*Primary Examiner*—William F. Pate, III

*Attorney, Agent, or Firm*—Norvell & Associates

[57] ABSTRACT

A subterranean well valve assembly includes a valve mounted within an annular housing which is actuated by an annular plunger co-axially mounted within the housing. The plunger is longitudinally shiftable to open the valve, in response to a fluid pressure signal. Within the housing, releasable latches are provided for engaging an annular groove, thereby temporarily locking the plunger in its lower position. The valve assembly also includes a permanent lock open mechanism comprising an annular locking mandrel, including a latch element. Longitudinal movement of the mandrel locks the mandrel in place, thereby interfering with subsequent retraction of the plunger from locked position.

12 Claims, 6 Drawing Figures

SUBTERRANEAN WELL VALVE WITH LOCK OPEN MECHANISM

BACKGROUND OF THE INVENTION

1. Field of the Invention

The invention relates to a valve having temporary and permanent lock open mechanisms, adapted for downhole use in a subterranean well.

2. Description of the Prior Art

Valves used in subterranean wells, such as flapper-type safety valves responsive to a pressure signal, are known in the art. A typical normally closed valve may be held open by means responsive to a fluid pressure control signal from the surface. When the control pressure is reduced, the responsive means is actuated to permit the valve to close. It is often desirable for such a valve to have a releasable temporary lock open feature, whereby the valve may be locked open without the necessity for a continuous pressure signal. Some prior designs have included a temporary lock open mechanism incorporated as an integral part of the valve opening and closing mechanism. For example, the lock open mechanism has commonly been included in a moving plunger which directs the valve to open position. The placement of the lock mechanism on the plunger presents the possibility of a malfunction in which the lock mechanism would fail to release, or would stick, as an attempt was made to withdraw the plunger and close the valve.

SUMMARY OF THE INVENTION

The invention provides a valve assembly having a releasable temporary lock open mechanism located below the valve head.

In one form, an annular housing contains the valve, for instance, a flapper valve having a valve head pivotally retractable into a side pocket. The flapper head is hinge mounted and biased by a torsion spring to a closed position. Above the valve, an annular plunger is disposed within the housing, and is downwardly shiftable to push open the valve. The plunger is spring biased upwardly by a helical power spring for the closed valve position. An annular piston secured to and disposed above the plunger defines part of a pressure chamber, to which a fluid pressure signal from the surface is applied. Sufficient pressure will move the piston and plunger downwardly against the biases of the aforementioned springs, pushing open the valve. Hence, the valve will remain in the open position so long as the control pressure is maintained, and will return to a closed position when the pressure is reduced. A lock open mechanism is disposed within the housing, upstream of the valve and is selectively passive with respect to movement of the plunger during shifting of the plunger. In the valve open position, the plunger extends through the annular valve seat and below the valve, adjacent the lock open mechanism. When actuated, the lock open mechanism releasably engages the lower end of the plunger, thus preventing its upward retraction, even if control pressure is reduced, thereby locking the valve open. The lock mechanism comprises an annular, axially shiftable sleeve, at the top of which is mounted a plurality of circumferentially spaced, upwardly extending latch fingers. The upper ends of the latch fingers include heads adapted to engage an annular groove formed in the outside cylindrical surface of the plunger. The inside surface of the housing tapers upwardly and inwardly above the latch fingers, whereby the latch fingers are cammed inwardly into tight engagement with the annular groove when the sleeve and fingers are shifted upwardly. The lock sleeve is spring biased to the upper locking position, but is normally retained in a lower position by a plurality of circumferentially spaced release keys linking the locking sleeve to a lower, annular release key mandrel. The keys and mandrel may be manipulated by a wire line tool to release the keys and actuate the lock. When the keys are released, the sleeve is urged upwardly by the spring bias, and the latch fingers are cammed into engagement with the groove formed in the plunger. The lock open mechanism may be reset to its normal unlocked position by a downward movement of the plunger in response to increased control pressure. In the event of a valve failure, the valve may be permanently locked open. Therefore, the valve assembly also includes a permanent lock open lock mechanism disposed downstream of the valve. The permanent lock open mechanism includes an annular locking mandrel above the piston which may be shifted to contact the piston. As the mandrel is shifted further, the piston and plunger move, thereby opening the valve. A resilient collet carried by the mandrel then expands outwardly and underneath an inwardly projecting shoulder of the housing, thereby preventing retraction of the mandrel and the reclosing of the valve.

DESCRIPTION OF THE PREFERRED EMBODIMENTS

Figure 1B:
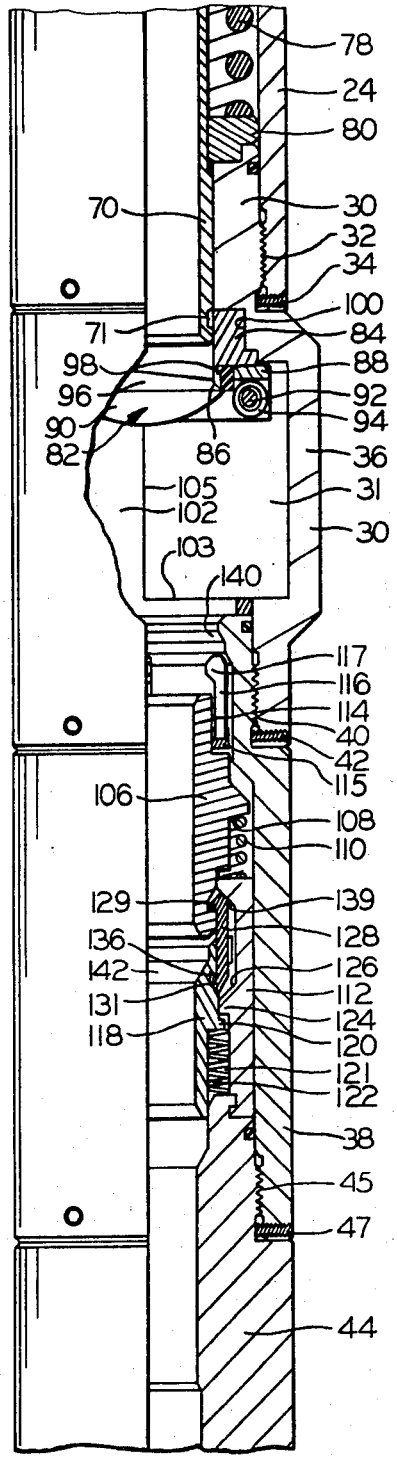
FIGS. 1*a* and 1*b* are elevational views, partly in section, of a valve assembly embodying the invention, the valve assembly illustrated in a normally closed configuration, FIG. 1*b* being a lower continuation of FIG. 1*a*.
Figure 1A:
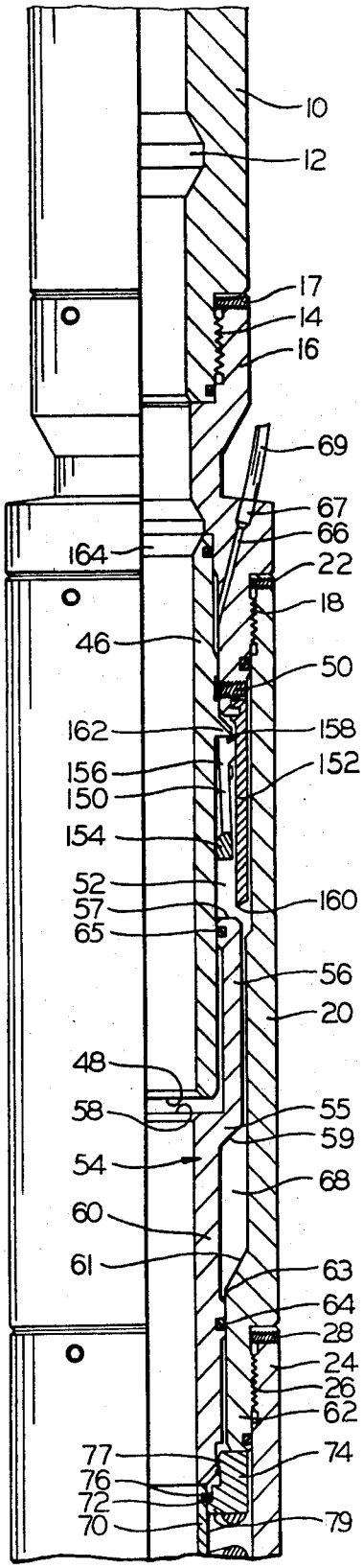

Referring to FIGS. 1*a* and 1*b*, valve assembly, which is illustrated as a flapper-type, tubing mounted safety valve, includes a top nipple adapter 10, which would typically be threadably secured to the lower end of a tubing string (not illustrated). The nipple adapter 10 includes an internal landing groove 12, in which a second safety valve may be landed by conventional techniques, in the event of the failure of the primary safety valve 82, to be later described. The nipple adapter 10 is attached by means of threads 14 to a top sub 16. The provision of the nipple adapter 10 as a component separable from the top sub 16 permits ready substitution of different nipple adapters, when the valve assembly is to be made up to accommodate differing seal bore sizes or threads. The threaded connection of the nipple adapter 10 to the top sub 16 is secured by radial set screws 17 above the threads 14.

The top sub 16 is attached by a threaded connection 18 to an annular upper housing 20. The threaded connection 18 also includes radial set screws 22. The upper housing 20 is secured at its lower end to an annular outer housing 24 by means of a threaded connection 26 and set screws 28. An annular valve housing 30 is secured to the lower end of the outer housing 24 by means of a threaded connection 32 and set screws 34. The valve housing includes an outwardly projecting side pocket 36, formed to accommodate the flapper valve head 90, in an interior valve chamber 31. Below the projecting side pocket 36, the valve housing 30 is connected to a temporary lock open housing 38 through a threaded connection 40 and radial set screws 42. A bottom sub 44 is connected to the lower end of the temporary lock open housing 38 by a threaded connection 45 and set screws 47.

The valve 82 and lock open mechanisms are disposed within the annular housing defined by the top sub 16, the outer housing 24, the valve housing 30, the temporary lock open housing 38, and the bottom sub 44.

An annular locking mandrel 46 (FIG. 1*a*) is secured to the inside surface of the top sub 16 by a radial shear pin 50. The locking mandrel 46 has a smaller outside diameter than the inside diameter of the upper housing 20. Therefore, the upper housing 20 and the locking mandrel 46 define between them an annular chamber 52.

An axially shiftable annular piston 54 is provided which includes an upper portion 56 having a top surface 57 disposed in the annular chamber 52 between the locking mandrel 46 and the upper housing 20. Below the bottom annular surface 48 of the locking mandrel 46, the piston 54 includes an integral cross over section 55 having an upwardly facing shoulder 58 spaced below the bottom surface 48 of the locking mandrel 46, and a downwardly facing shoulder 59. The cross over section 55 provides a transition from the upper piston portion 56 to a lower piston section 60 which has inside and outside diameters approximately equal to those of the locking mandrel 46.

Above the threaded connection 26, the inner surface of the upper housing 20 tapers inwardly as at 61 to a reduced inside diameter portion 62 having an inside diameter slightly larger than the outside diameter of the lower piston 60. An elastomeric O-ring 64 carried by the lower piston section 60 forms a sliding seal against the inside surface 62 of the upper housing 20. The lower piston section 60 includes an upwardly facing annular surface 63 above the O-ring 64. An elastomeric O-ring 65 carried by the inner surface of the upper section 56 of the piston 54 forms a sliding seal against the outside surface of the locking mandrel 46. A pressure chamber 68 is thereby defined between the O-rings 64 and 65, including the annular chamber 52 between the locking mandrel 46 and the upper housing 20, and the annular chamber 68 between the lower section 60 of the piston 54 and the upper housing 20. The chamber 68 includes the upwardly facing shoulders 57 and 63 and the downwardly facing surface 59 of the piston 54. These surfaces 57, 59 and 63 are so proportioned that fluid pressure within the chamber 68 exerts a net downward force on the piston 54.

The chamber 68 is in fluid communication with a conduit 66 formed in the top sub 16, and having a threaded port 67. A flexible conduit 69 is attached to the port 67 and extends upwardly alongside the nipple adapter 10 and the tubing string (not illustrated) to the surface. Typically, the conduit 69 is banded to the tubing string.

An annular plunger 70 is secured to the lower end of the piston 54 by means of a split ring 72 and a piston coupling nut 74. During assembly of the piston 54 and plunger 70, the split ring 72 is snapped into an annular groove 76 formed in the outside cylindrical surface of the plunger 70. The piston coupling nut 74 is attached to the piston 54 by means of a threaded connection 77. An inwardly projecting flange 79 of the piston coupling nut 74 underlies the split ring 72, thus maintaining the plunger 70 and piston 54 in attached relationship. The lower end of the plunger 70 includes an annular groove 71 (FIG. 1*b*) formed in its outside cylindrical surface.

The plunger 70 extends downwardly into the valve housing 30. Within the annular space between the plunger 70 and the outer housing 24 a helical power spring 78 extends between the piston coupling nut 74 and a lower annular spring stop 80. The spring 78 thus exerts an upward bias on the piston 54 and plunger 70, urging them to the position shown in FIG. 1*a*. The spring stop 80 also acts as a bearing and alignment member for axial sliding movement of the plunger 70.

As mentioned, the safety valve 82 is disposed within the valve housing 30. Although the particular valve illustrated and described is a hinged flapper valve, other valves actuatable by movement of a plunger, such as 70, could be employed. The valve 82 comprises an annular valve seat 84 having a conical sealing surface 86. The valve 82 also comprises a valve base 88, to which the flapper valve head 90 is hingedly secured. The hinged attachment of the valve head 90 to the valve base 88 comprises a hinge pin 92 and a torsion spring 94 which biases the valve head 90 to the closed position illustrated in FIG. 1, in a conventional manner. The valve head 90 includes a conical sealing surface 96 adapted to form a seal against the complementary sealing surface 86 of the valve seat 84. The sealing surfaces 96 and 86 are precision machined, to provide a high pressure, metal-to-metal seal. A secondary, low pressure seal is formed by the contact of the valve head 90 with an elastomeric sealing ring 98 which is held between the valve seat 84 and the valve base 88.

During assembly of the valve 82, the valve seat 84 is placed co-axially relative to the plunger 70, against the complementary upper surface 100 of the valve chamber 31. The valve base 88, the elastomeric sealing ring 98, the valve head 90, and the hinge pin 92 are assembled into place, and supported by the valve support member 102. The valve support member 102 includes a lower ring 103 defining the lower limit of the valve chamber 31, and an upwardly extending, integral, cylindrical segment 105 which contacts the valve base 88.

Figure 2B:
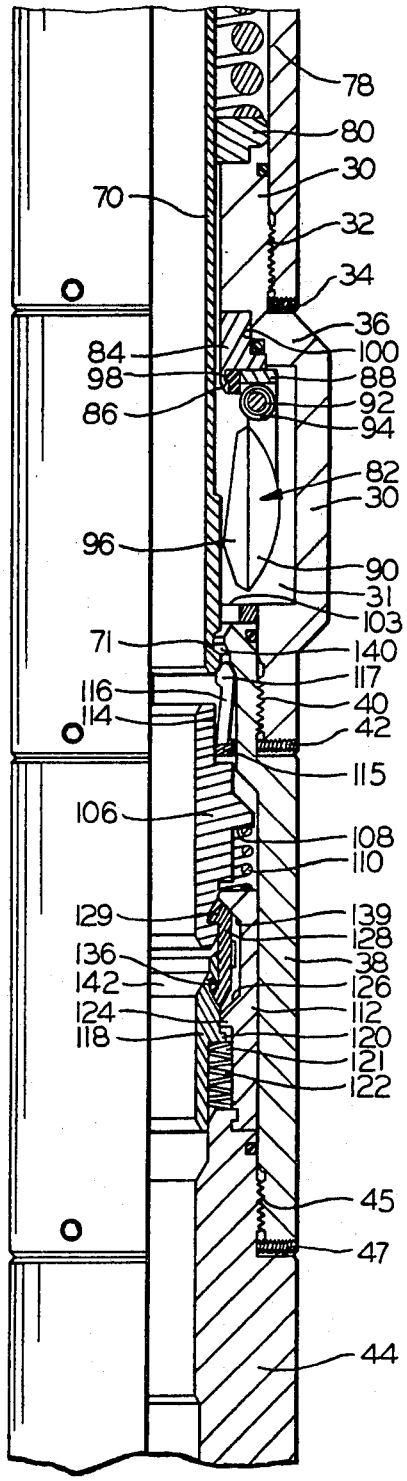
FIGS. 2*a* and 2*b* are elevational views, partly in section, similar to FIGS. 1*a* and 1*b*, but with the valve assembly in a valve open position, maintained by a continuous fluid pressure signal from the surface.

As illustrated in FIG. 1*b*, the entire valve assembly is held in assembled position when the temporary lock open housing 38 is threadably attached to the valve housing 30. The upper surface of the temporary lock open housing 38 abuts the ring portion 103 of the valve support member 102 and presses the cylindrical segment 105 tightly against the valve base 88. The cylindrical support segment 105 is oriented opposite the side pocket 36, providing a free path for the valve head 90 to pivot into the open position illustrated in FIG. 2*b*.

A temporary lock open mechanism is disposed within the temporary lock open housing 38, below the valve housing 30. The temporary lock open mechanism comprises an annular, axially shiftable temporary lock open sleeve 106. The temporary lock open sleeve 106 includes an outwardly projecting, downwardly facing shoulder 108 providing an upper spring stop for a helical temporary lock open spring 110. The lower end of the spring 110 rests on the upper surface of a temporary lock open cage 112, which is secured to, and extends upwardly from the bottom sub 44, within the lock open housing 38. The spring 110 biases the temporary lock open sleeve 106 upwardly towards the position illustrated in FIG. 3.

An annular recess 114 is formed in the outside cylindrical surface of the lock open sleeve 106, adjacent the top of the lock open sleeve 106. A plurality of resilient, axially extending, circumferentially spaced latch fingers 116 are disposed in the recess 114, and extend upwardly therefrom. The latch fingers 116 are interconnected by an integral annular base 115. The upper ends of the latch fingers 116 include enlarged heads 117 adapted to engage the aforementioned groove 71 of the plunger 70.

An annular temporary lock open mandrel 118 is slidably mounted within the lock open cage 112, below the lock open sleeve 106. The lock open mandrel 118 includes an outwardly projecting, annular flange 120. Below the flange 120, the outer surface of the lock open mandrel 118 is inwardly recessed, thereby providing an annular space 121 between the lock open mandrel 118 and the lock open cage 112. A plurality of annular, resilient, Belleville springs or washers 122 are stacked within the annular space 121 between the top of the bottom sub 44 and the flange 120. The Belleville washers 122 exert an upward bias on the lock open mandrel 118. The engagement of the flange 120 with a flange 124 inwardly projecting from the lock open cage 112 limits the upward movement of the lock open mandrel 118. The flange 124 includes an outwardly and upwardly tapering upper shoulder 126.

A plurality of circumferentially spaced release keys 128 extend axially between the temporary lock open sleeve 106 and the temporary lock open mandrel 118, in the annular space between the lock open cage 112, and the lock open sleeve 106 and lock open mandrel 118. The release keys 128 link the lock open sleeve 106 and the lock open mandrel 118, holding the lock open sleeve 106 down against the upward bias of the spring 110. Each release key 128 includes enlarged upper and lower heads 129 and 131 respectively. The upper head 129 of each release key 128 includes a downwardly facing shoulder which engages an upwardly facing annular latch surface 132 (FIG. 3) on the lock open sleeve 106. Similarly, the lower head 131 of each release key 128 includes an upwardly facing shoulder which engages an inclined downwardly facing annular latch shoulder 136 on the lock open mandrel 118. The latch surface 136 tapers inwardly and upwardly. In the position illustrated in FIG. 1*b*, the upper heads 129 of the release keys 128 are prevented from swinging outwardly from engagement with the latch surface 132 by interference with the inclined downwardly facing annular latch shoulder 139 on the lock open cage 112.

OPERATION

Figure 2A:
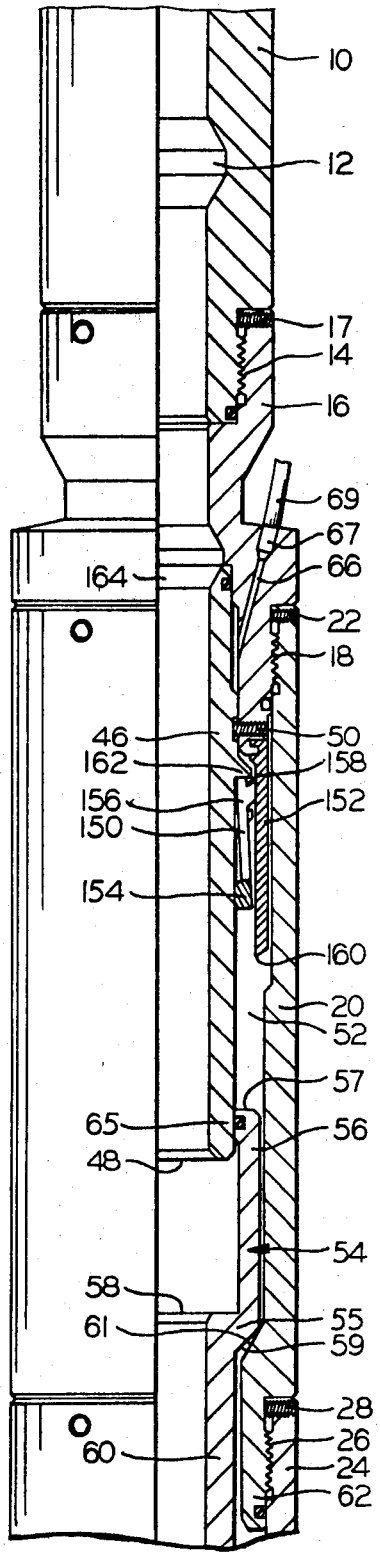

In FIGS. 1*a* and 1*b*, the valve assembly is illustrated in a normally closed position. When a fluid pressure signal of sufficient magnitude is applied to the pressure chamber 68 through the conduit 69 from the well surface, the assembly shifts to the position illustrated in FIGS. 2*a* and 2*b*. The differential areas of the piston 54 are so proportioned that pressure within the chamber 68 exerts a net downward force on the piston 54, moving it downwardly against the bias of the power spring 78. The valve head 90 is then pivoted downwardly by the plunger 70 on the hinge pin 92, into its retracted position within the side pocket 36. Production fluid can then flow unimpeded through the bore of the annular plunger 70. So long as the pressure control signal from the surface is maintained, the valve assembly will remain in this position, with the plunger 70 preventing the reclosing of the valve 82.

Figure 3:
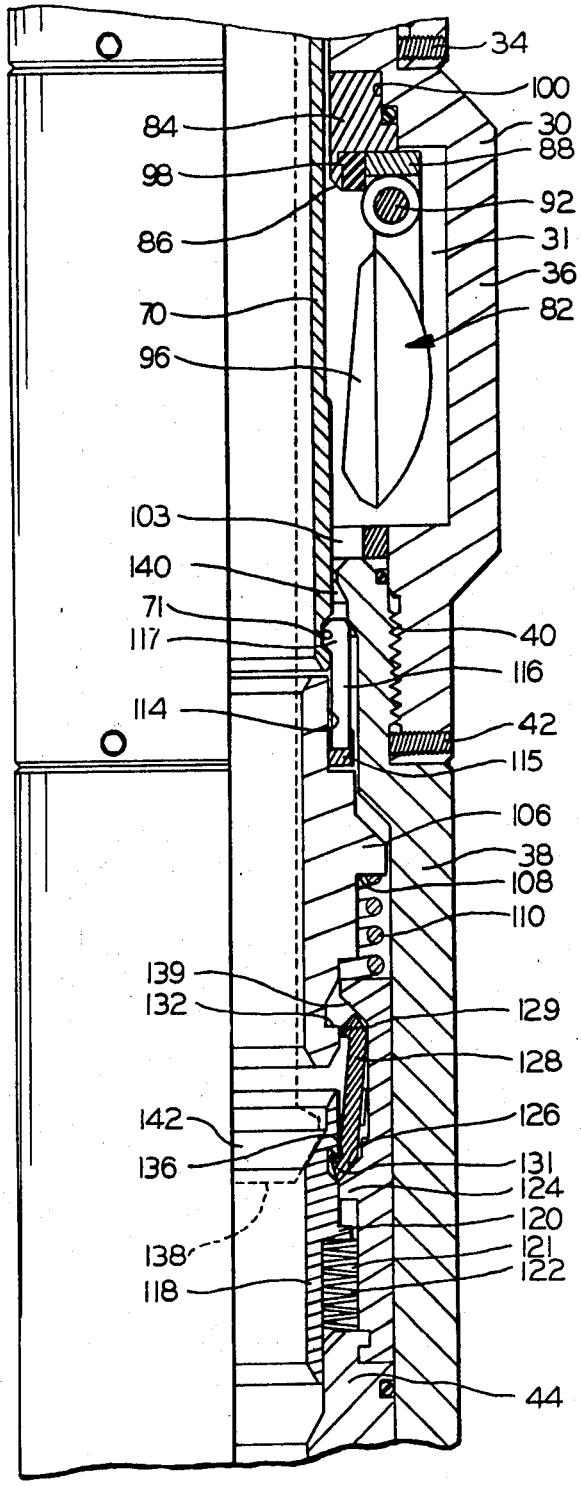
FIG. 3 is an enlarged scale elevational view, partly in section, similar to FIG. 2*b*, illustrating the actuation of the temporary lock open mechanism by an auxiliary tool.

In some situations, it may be desirable to temporarily lock the valve 82 open. As illustrated in FIG. 3, this may be done by means of a wire line tool 138 (illustrated in phantom line in FIG. 3) inserted through the piston 54, the plunger 70 and the valve seat 84. Normally, the temporary lock open sleeve 106 and the lock open mandrel 118 are linked together by the release keys 128. The lock open sleeve 106 is thereby retained downwardly against the bias of the spring 110. The latch fingers 116 are therefore not in a position to engage the annular groove 71 formed in the plunger 70. The lock open tool 138 releases the lock open sleeve 106 for upward movement as described below.

The temporary lock open tool 138 includes a lower flange adapted to engage an upwardly facing shoulder 142 on the lock open mandrel 118. To actuate the temporary lock, the lock open mandrel 118 is pushed downwardly by the wire line operated lock open tool 138, against the bias of the Belleville washers 122. The lock open mandrel 118 in turn pulls the release keys 128 downwardly, by engagement of the latch surface 136 of the lock open mandrel 118 and the lower heads 131 of the release keys 128. After the release keys 128 have shifted downwardly, the upper heads 129 of the release keys 128 are no longer in contact with the downwardly facing shoulder 139 of the lock open cage 112, and are thus free to shift outwardly. As the lock open mandrel 118 and the release keys continued to move downwardly, the lower heads 131 of the release keys 128 come into contact with the upwardly facing, inwardly tapering shoulder 126 of the lock open cage 112. The shoulder 126 cams the lower heads 131 of the release keys 128 inwardly, causing the release keys 128 to pivot on the outer circular edge of the latch surface 136 as a fulcrum. The release keys 128 are thus pivoted to the position illustrated in FIG. 3, and no longer link together the lock open mandrel 118 and the lock open sleeve 106.

The lock open sleeve 106 is thus released to move upwardly under the urging of the spring 110. The lock open sleeve 106 carries upwardly with it the latch fingers 116 disposed within the recess 114. As the resilient latch fingers 116 move upwardly, the heads 117 spread around the outside cylindrical surface of the the plunger 70 and continue to move upwardly until they engage an inwardly and upwardly tapering camming surface 140 of the temporary lock open housing 38. The heads 17 are cammed into tight engagement with the annular groove 71 formed in the outside cylindrical surface of the plunger 70. When the lock open tool 138 is removed, the valve assembly remains in a lock open position. The upwardly directed force exerted on the plunger 70 and the latch fingers 116 by the power spring 78 increases the radially inward force exerted on the latch finger heads 117 by the camming surface 140. A secure, locking engagement of the latch fingers 116 within the groove 71 is thereby assured. The valve assembly is thereby temporarily mechanically locked open without the necessity for maintaining a continuous pressure in the pressure chamber 68.

The temporary lock may be unlocked, and the valve 82 reopened, by applying additional pressure through the conduit 69 to the pressure chamber 68. The plunger 70 will move downwardly as described above, forcing the lock open sleeve 106 downwardly. The bottom of the lock open sleeve 106 will contact the top heads 129 of the release keys 128 and begin to push the release keys 128 downwardly. Because the lock open mandrel 118 and the release keys 128 are no longer held downwardly by a lock open tool 138, they continue to be urged upwardly by the Belleville washers 122 toward the latch position, illustrated in FIG. 1*b*. Therefore, when the lock open sleeve 106 has moved downwardly to allow sufficient clearance, the upper heads 129 of the release keys 128 re-engage the groove defined by the latch surface 132 on the lock open sleeve 106. The release keys 128 are again retained in this position by the upward bias of the Belleville washers 122 and by the camming surface 139 of the lock open cage 112. After the lock open sleeve 106 is thereby returned and latched into the lower position, the plunger 70 is free to retract upwardly by reduction of pressure in the chamber 68, without interference from the latch fingers 116.

Figure 4:
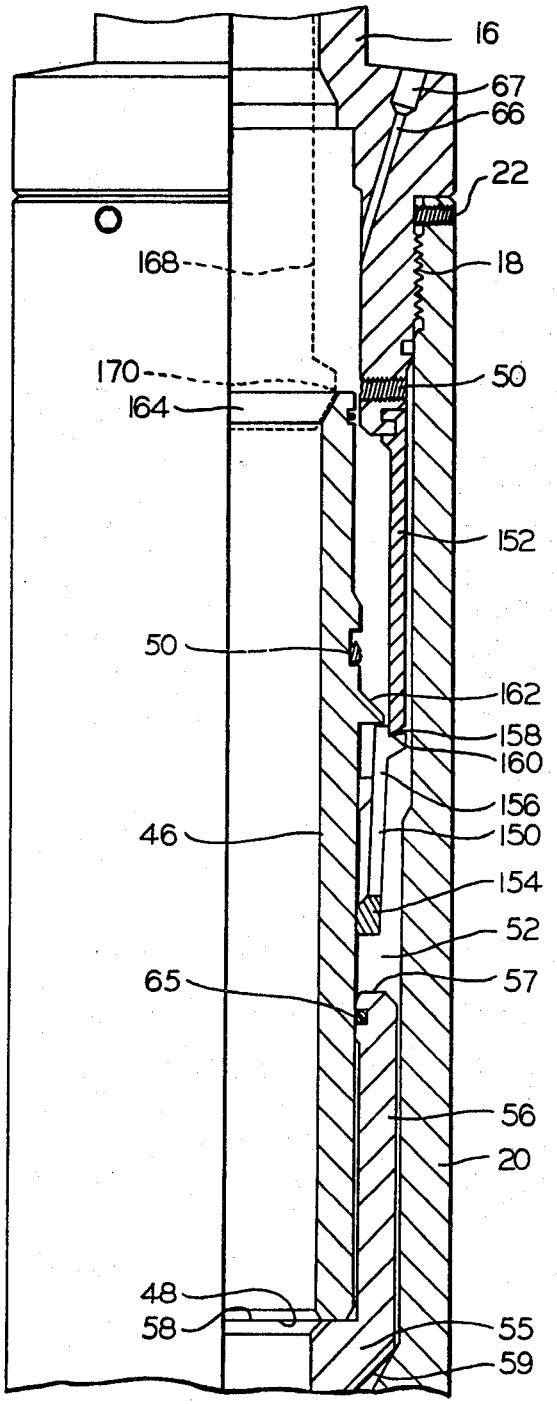
FIG. 4 is an enlarged elevational view, partly in section, of the upper portion of the valve assembly embodying the invention, illustrating the operation of the permanent lock open mechanism.

In the event of a malfunction of the valve 82, it may be permanently locked open by the permanent lock open mechanism illustrated in an actuated position in FIG. 4. The permanent lock open mechanism comprises the permanent locking sleeve mandrel 46, an upper lock collet 150, and an annular upper cage 152. The upper lock collet 150 includes an annular base 154 surrounding the permanent locking mandrel 46, within the annular space 52. A plurality of axial, resilient latch keys 156 extend upwardly from the annular base 154. An upwardly opening notch 158 is formed at the top of each latch key 156. The annular upper cage 152 surrounds the upper lock collet 150. The upper cage 152 is secured to the top sub 16, and is disposed concentrically between the permanent locking mandrel 46 and the upper housing 20. The resilient latch keys 156 are biased radially outwardly, but are normally restrained against outward expansion by the inside cylindrical surface of the upper cage 152. The lower end of the upper cage 152 provides a circular edge 160 adapted to engage the notches 158 in the latch keys 156. The locking mandrel 46 includes an outwardly projecting annular shoulder 162 above the latch keys 156. The upper end of the permanent locking mandrel 46 comprises an upwardly and outwardly tapering surface 164. In the closed valve position illustrated in FIG. 1*a*, the surface 164 and the inner surface of the top sub 16 define a tool recess.

When it is desired to permanently lock the valve 82 in an opened position, a wire line controlled, permanent lock open tool 168 (illustrated in phantom line in FIG. 4) is landed in the tool landing recess defined by surface 164. The permanent lock open tool 168 includes a lower flange 170 expandable radially to contact the upper surface 164 of the permanent lock open mandrel 46. The permanent lock open tool 168 is then jarred downwardly until the shear pin 50 shears, thereby releasing the permanent locking mandrel 46 for downward movement to the permanent lock open position illustrated in FIG. 4. As the permanent lock open tool 168 and the permanent locking mandrel 146 are moved downwardly, the lower surface 48 of the permanent lock-open mandrel 46 contacts the upper surface 58 of the piston 54, and thereby pushes the piston 54 and plunger 70 to the valve open position. As the permanent locking mandrel 46 moves downwardly, the annular shoulder 162 engages the tops of the latch keys 156, thereby forcing the upper lock collet 150 downwardly. As the latch keys 156 move below the lower end of the upper cage 152, the latch keys 156 spring outwardly forcing the notches 158 into engagement with the lower edge 160 of the upper cage 152, thereby preventing return of the upper collet 150 to its original position. When the permanent lock open tool 168 is removed, the annular base 154 of the upper lock collet 150 interferes with upward movement of the piston 54 urged by the upward bias of the power spring 78. The valve assembly is thus in a permanently locked open position.

The valve assembly described provides a reliable tubing mounted safety valve having a lock mechanism. The provision of the temporary lock open mechanism within the lock open housing 38 below the valve 32 offer several advantages. The lock open mechanism is independent of the pressure-controlled operation of the plunger 70, increasing overall reliability of the valve assembly. Because the temporary lock open mechanism is separate from the valve 82 and plunger 70, there is little chance of damage to the temporary lock open mechanism in the event the valve 82 is slammed closed. Furthermore, if the user requires no lock open mechanism, the lock open housing 38 including the associated lock open mechanism can be replaced by an appropriate simple bottom sub. The permanent lock open feature provides additional flexibility to the user.

Although the invention has been described in terms of specified embodiments which are set forth in detail, it should be understood that this is by illustration only and that the invention is not necessarily limited thereto, since alternative embodiments and operation techniques will become apparent to those skilled in the art in view of the disclosure. Accordingly, modifications are contemplated which can be made without departing from the spirit and of the described invention.

What is claimed and desired to be secured by Letters Patent is:

1. A valve assembly adaptable for mounting on a tubular conduit in a subterranean well, comprising, in combination: an annular housing defining a fluid flow path; a valve within said housing including annular valve seat means, and valve head means shiftable between open and closed position cooperating with said valve seat means to close said valve and said fluid flow path; first biasing means for urging said valve head means to closed position; shiftable valve actuating means for opening and holding open said valve against the bias of said biasing means; means for shifting said valve actuating means downwardly to open said valve head mean and means for shifting said valve actuating means upwardly for closing said valve head means; and releasable latch means for locking said valve actuating means in the open valve position, said latch means being shiftably mounted within said housing upstream of said valve, said latch means being selectively passive to and during shifting of said valve actuating means.

2. The valve assembly defined in claim 1 wherein said valve actuating means comprises an annular plunger concentrically mounted within said housing upwardly biased and axially shiftable downwardly to open said valve in response to a fluid pressure control signal, said plunger having an axial bore providing a flow path through said opened valve.

3. The valve assembly defined in claim 1 wherein said latch means comprises radially shiftable latch keys engagable with said actuating means and said housing.

4. The valve assembly defined in claim 3 wherein said housing includes means for camming said latch keys into engagement with said valve actuating means, and further including second biasing means urging said latch keys upwardly to a position of cam-blocked engagement with said valve actuating means, and releasable means for retaining said latch keys against the force of said second biasing means.

5. The valve assembly defined in claim 3 or 4 wherein said valve actuating means comprises an annular plunger concentrically mounted within said housing, upwardly biased and axially shiftable downwardly to open said valve in response to a fluid pressure control signal, said plunger having an axial bore providing a flow path through said open valve, and including an annular groove formed in the outer surface of said plunger for engagement with said latch keys.

6. The valve assembly defined in claim 1 including shiftable mechanical means for shifting said valve actuating means downwardly against said first biasing means, and resilient permanent locking means engagable with said housing and said means for shifting said valve actuating means, thereby preventing upward retraction of said valve actuating means.

7. The valve assembly defined in claim 6 wherein said valve actuating means comprises an annular plunger concentrically mounted within said housing, upwardly biased and axially shiftable downwardly to open said valve in response to a fluid pressure control signal, and said mechanical means for shifting said valve actuating means comprises an annular mandrel concentrically mounted within said housing and downwardly shiftable into contact with said plunger, and said reilient permanent lock means comprises a latch collet mounted on said permanent locking mandrel including axially extending, outwardly biased latch fingers, expandable into engagement with said housing after a predetermined downward travel of said permanent lock mandrel.

8. A valve assembly adaptable for mounting on a tubular conduit in a subterranean well, comprising, in combination: an annular housing defining a fluid flow path; a valve within said housing including annular valve seat means, and valve head means shiftable between open and closed position cooperating with said valve seat means to close said valve and said fluid flow path; first biasing means for urging said valve head means to closed position; fluid pressure actuated shiftable valve actuating means for opening and holding open said valve against the bias of said biasing means; and releasable latch means for locking said valve actuating means in the open valve position, said latch means being shiftably mounted within said housing upstream of said valve, said latch means being independent of pressure actuation of the valve actuating means during shifting of said valve actuating means.

9. A valve assembly adaptable for mounting on a tubular conduit in a subterranean well, comprising, in combination: an annular housing defining a fluid flow path; a valve within said housing including annular valve seat means, and valve head means shiftable between open and closed position cooperating with said valve seat means to close said valve and said fluid flow path; first biasing means for urging said valve head means to closed position; shiftable valve actuating means for opening and holding open said valve against the bias of said biasing means; means for shifting said valve actuating means downwardly to open said valve head means and means for shifting said valve actuating means upwardly for closing said valve head means; and releasable latch means for locking said valve actuating means in the open valve position, said latch means being shiftably mounted within said housing and detachably affixed to the housing upstream of said valve, said latch means being selectively passive to and during shifting of said valve actuating means.

10. A valve assembly adaptable for mounting on a tubular conduit in a subterranean well, comprising, in combination: an annular housing defining a fluid flow path; a valve within said housing including annular valve seat means, and valve head means shiftable between open and closed position cooperating with said valve seat means to close said valve and said fluid flow path; first biasing means for urging said valve head means to closed position; shiftable valve actuating means for opening and holding open said valve against the bias of said biasing means; and releasable latch means for locking said valve actuating means in the open valve position, said latch means being mounted within said housing upstream of said valve, said latch means being shiftable relative to said housing and to said valve actuating means, said latch means being selectively passive to and during shifting of said valve actuating means.

11. A valve assembly adaptable for mounting on a tubulr conduit in a subterranean well, comprising, in combination: an annular housing defining a fluid flow path; a valve within said housing including annular valve seat means, and valve head means shiftable between open and closed position cooperating with said valve seat means to close said valve and said fluid flow path; first biasing means for urging said valve head means to closed position; shiftable valve actuating means for opening and holding open said valve against the bias of said biasing means; means for shifting said valve actuating means downwardly to open said valve head means and means for shifting said valve actuating means upwardly for closing said valve head means; and latch means for locking said valve actuating means in the open valve position, said latch means being shiftably mounted within said housing upstream of said valve; said latch means being selectively passive to and during shifting of said valve actuating means, and said latch means being releasable upon upstream movement of said valve actuating means.

12. A valve assembly for mounting on a tubular conduit in a subterranean well, comprising, in combination: an annular housing defining a fluid flow path; a valve within said housing including annular valve seat means, and valve head means shiftable between open and closed position cooperating with said valve seat means to close said valve and said fluid flow path; first biasing means for urging said valve head means to closed position; valve actuating means for opening and holding open said valve against the bias of said biasing means, shiftable from a valve closed position to a valve open position; means for shifting said valve actuating means downwardly to open said valve head means and means for shifting said valve actuating means upwardly for closing said valve head means; and releasable latch means for locking said valve actuating means in the open valve position, said latch means being shiftably mounted within said housing upstream of said valve, said latch means being selectively passive to and during shifting of said valve actuating means.

* * * * *